United States Patent [19]

King

[11] Patent Number: 4,824,079

[45] Date of Patent: Apr. 25, 1989

[54] INJECTION VALVE COMPONENTS AND METHOD

[75] Inventor: Patrick D. King, Rantoul, Ill.

[73] Assignee: Flo-Con Systems, Inc., Champaign, Ill.

[21] Appl. No.: 885,873

[22] Filed: Jul. 15, 1986

[51] Int. Cl.[4] ..... C21C 5/48

[52] U.S. Cl. ..... 266/44; 266/225; 266/265; 266/270; 266/287

[58] Field of Search ..... 266/44, 45, 47, 220, 266/265, 266, 270, 271, 287, 225; 222/596, 599, 601, 603, 600

[56] References Cited

U.S. PATENT DOCUMENTS

| | | | |
|---|---|---|---|
| 3,581,948 | 6/1971 | Detalle | 266/272 |
| 3,794,218 | 2/1974 | Yanagida et al. | 266/271 |
| 4,219,188 | 8/1980 | Meier | 222/603 |
| 4,222,553 | 9/1980 | Edamoto | 266/47 |
| 4,424,958 | 1/1984 | Bachmann | 266/271 |
| 4,575,393 | 3/1986 | Bates et al. | 266/225 |
| 4,582,232 | 4/1986 | Shapland et al. | 222/600 |

FOREIGN PATENT DOCUMENTS

| | | | |
|---|---|---|---|
| 2801487 | 7/1978 | Fed. Rep. of Germany | 266/266 |
| 717139 | 2/1980 | U.S.S.R. | 266/87 |

*Primary Examiner*—L. Dewayne Rutledge
*Assistant Examiner*—Robert L. McDowell
*Attorney, Agent, or Firm*—Jack E. Dominik

[57] ABSTRACT

An injection valve which is positioned on the underneath portion of a teeming vessel is disclosed. The valve itself includes a mounting plate, and a well block nozzle which is in open communication with the metal being teemed in the vessel. Beneath the sliding injection plate a sliding plate carrier is positioned which is engaged by spring loaded rocker arms in order to maintain a compressive relationship between the sliding plate carrier, the sliding injection gate, and the stationary plate. Optionally the injection valve is fed by a plurality of injectants supplied which are adjusted by means of a control valve. In addition, wire may also be injected simultaneously with gas, or other additives. In addition, power means are provided for replacing the sliding plate carrier, and also the sliding plate. Alternatively means are provided for disengaging the rockers, and manually replacing the same.

14 Claims, 4 Drawing Sheets

INJECTION VALVE COMPONENTS AND METHOD

FIELD OF THE INVENTION

The present invention is directed to an injection valve, and more particularly an injection valve which can desirably be positioned at the lower portion of a metal teeming vessel for the injection of additives to the metal including solids and gases, the latter intended to agitate and disburse the additives.

SUMMARY OF THE PRIOR ART

The prior art is directed to the field known as "ladle metalurgy". When steel is formed in an open hearth furnace, a basic oxygen furnace, or by any other technique including the remelting and purification of scrap, it is normally tapped off of the furnace or refining vessel into a ladle. The ladle is then transported to a metalurgical platform or station. At this point additives such as nickel, molybdenum, sulfur, and even lead can be introduced to the steel. Oftentimes this is done by a lance introduced from above the vessel which is blowing argon or another inert gas along with the additives. The lance itself is consumed in the process but necessarily sacrificed to deliver the additives to a position beneath whatever slag may be atop the ladle.

More recently such efforts have been disclosed in the following United States patents have been directed to the general subject matter: U.S. Pat. Nos. 3,395,910; 3,633,898; 3,809,146; 3,820,768; 3,931,913; 3,997,148; 3,997,334; 4,004,792; 4,268,017; 4,285,504; 4,298,192; 4,317,561; 4,355,789; 4,392,636; 4,392,637; 4,401,466; 4,413,815; 4,421,257; 4,423,858; 4,428,546; 4,449,701; 4,494,735; 4,502,670; 4,509,977; and 4,572,482. As will be seen, the various examples position the injection of additives at various locations of the vessel.

More recently, as exemplified in PCT application PCT/GB83/00279 of Nov. 21, 1983, a valve known as the "Injectall" has been introduced into the market place. This valve is positioned on a side of the metal teeming vessel. As will be noted its parts are detailed, and it does suffer from the limited disadvantage of not being positioned at the bottom of the vessel where any gas injected can cause agitation throughout the entire contents of the vessel, rather than just at the level above the point of injection. All gases when introduced into a vessel generally migrate upwardly from the point of introduction.

SUMMARY OF THE INVENTION

The present invention is directed to an injection valve which is positioned on the underneath portion of a teeming vessel. It may be positioned under a ladle, or under a tundish. The valve itself includes a mounting plate, and a well block nozzle which is in open communication with the metal being teemed in the vessel. Beneath the well block nozzle is a stationary plate, therebeneath a sliding plate which may be imperforate, perforate, or have an opening containing a porous plug or ceramic sieve depending upon the type of injection. Beneath the sliding injection plate a sliding plate carrier is positioned which is engaged by spring loaded rocker arms in order to maintain a compressive relationship between the sliding plate carrier, the sliding injection plate, and the stationary plate. Centrally of the sliding plate carrier is a coupler which, in turn, is connected to a further coupler, an injection hose, and an injection supply for delivering additives to the vessel through the injection valve. Optionally the injection valve is fed by a plurality of injectants supplied which are adjusted by means of control valves. In addition, wire may also be injected simultaneously with gas, or other additives. The wire normally is advanced rapidly at speeds between 60 and 100 feet per second. This permits the wire to advance into the vessel and be melted at a point somewhat above the injection valve and thereafter disbursed by an inert gas. In addition, power means are provided for replacing the sliding plate carrier, and also the sliding plate. Alternatively means are provided for disengaging the rockers, and manually replacing same. The method of operation includes preparing the injection valve after a pour has been completed by lancing the same in a partially disassembled form, utilizing a plug, and thereafter assembling and operating the same. The method is also directed to the power change of the spent elements.

In view of the foregoing it is a principal object of the present invention to provide a method of operating an injection valve and construction of an injection valve which permit ladle metalurgy at a lower portion of a teeming vessel, irrespective of whether it is a ladle designed for intermediate transport, or a tundish which is teeming directly into an ingot or a continuous caster.

A further object of the present invention is to provide an injection valve which can be positioned on an underneath portion of a vessel, and which has positive shut-off means which permit the same to be activated without reverse flow of the metal being teemed, and which further permits the shut-off and subsequent purging to reactivate the injection valve.

Still another of many objects of the present invention look to the provision of an injection valve and a method of operating the same which is simple, safe, and economically desirable because of the limited number of parts in contact with the extremely high temperature of the teeming vessel and the molten metal contained in the vessel.

BRIEF DESCRIPTION OF THE DRAWINGS

Further objects and advantages of the present invention will become apparent as the following description of an illustrative embodiment proceeds, taken in conjunction with the illustrative drawings, in which.

DESCRIPTION OF A PREFERRED EMBODIMENT

Figure 1:
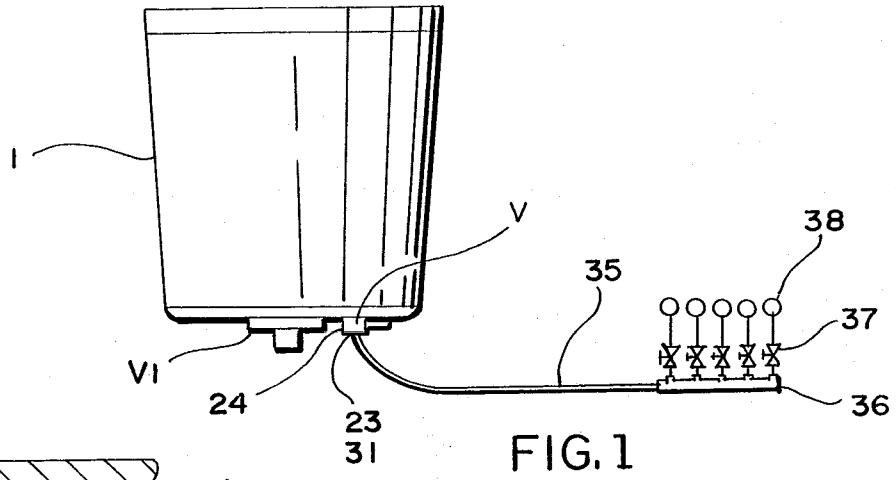
FIG. 1 is a partially diagrammatic perspective view of a metal teeming vessel showing the subject injection valve, and adjacent teeming valve, and the additive system.

As noted in FIG. 1, a teeming vessel 1 is shown having an outer shell. The injection valve V illustrative of the present invention is secured on the underneath side of the vessel shell. Normally and centrally located under the teeming vessel 1, is a bottom pour valve V' which actually controls the flow of molten metal from the teeming vessel shell 1 into a tundish, ingot, or other metal processing station. As shown in longitudinal section in FIG. 2, the injection valve V is secured to the teeming vessel 1 by means of a mounting plate 2. A well nozzle 3 extends inwardly and in fluid communication with the molten metal in the teeming vessel 1. At the upper portion of the valve V, there is positioned a stationary plate 4 which nestingly receives the lower portion of the well nozzle 3. The stationary plate 4 has tapered edge portions to permit its removable securement in position. In addition, a sliding injection plate 5 is provided having an orifice which is the injection hole when in register with the injection hole of the stationary plate 4. A refractory clamp ring 8 secures the stationary plate 4 in position in a manner not unlike that disclosed in U.S. Pat. No. 4,582,232, entitled "Valve, Clamp, Refractory, and Method". A refractory clamp ring 8 also secures the sliding injection plate 5 for movement as will be defined below. A sliding plate carrier 10 is positioned beneath the sliding injection plate 5. The sliding plate carrier 10 includes a seal ring 11 intended to seal the interface between the sliding injection plate 5 and the sliding plate carrier 10 so that gases injected under pressure will not leak.

A carrier puller 12 in the form of a key shaped metal having a lug at one end portion is secured by means of a puller attachment screw 13 into position and in locking engagement with the sliding plate carrier 10. The ram 14 is secured to the sliding plate carrier 10 by the carrier puller 12 for moving the sliding injection plate 5 in and out of register with the orifice of the stationary plate 4 to permit injection, or in the alternative, to close the injection action during or after teeming a heat from the vessel 1. The ram 14 is actuated by the hydraulic cylinder 15 in a manner comparable to other sliding gate valves, and more particularly tundish valves of the character disclosed in U.S. Pat. No. 4,415,103.

The sliding plate carrier is urged into compressive relationship with the sliding injection gate 5 and the stationary injection plate 4 by means of rocker arm 16 which, includes, a spherical shoulder rocker arm pivot of the character disclosed in U.S. patent application Ser. No. 797,994 filed Nov. 14, 1985. The spherical shoulder rocker arm pivot 17 permits engagement by the spring 18 which is interior of the spring pad 19 and adjusted by means of cam follower 20. Cam follower 20 in turn is engaged by means of the spring compressor cam shaft 21 which is regulated by the cam shaft stop bar 22. Upon rotation of the spring compressor cam shaft 21 the spring pressure is released, the pressure on the rocker arm 16 is released, and the carrier assembly 10 along with the slide injection valve 5 may be removed.

Figure 2:
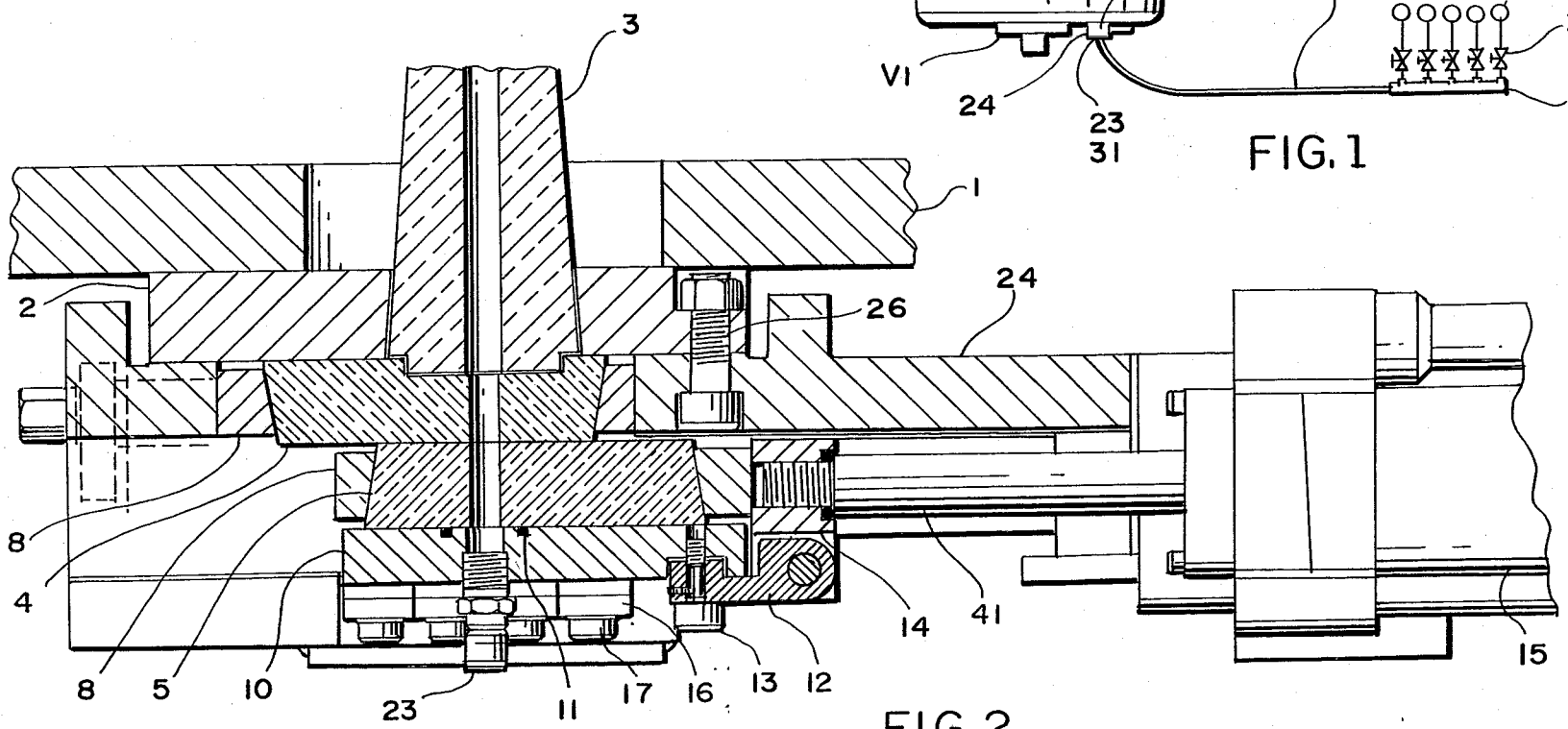
FIG. 2 is a longitudinal section of the subject injection valve, partially broken at the teeming vessel and well block nozzle portions.
Figure 3:
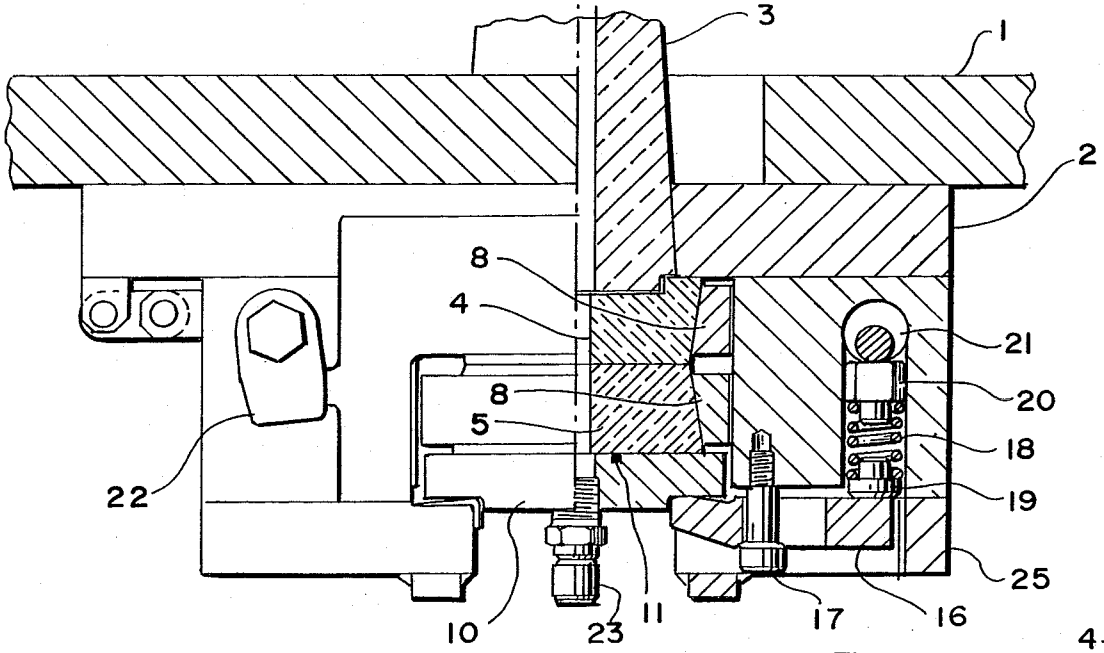
FIG. 3 is a cross-section or transverse sectional view taken in the same scale as FIG. 2 showing the interior portion and particularly the spring loading of the rocker arm assembly to compress the refractory members.

In FIG. 3, it will be seen that the entire injection valve V includes the mounting plate 2, and the injection valve frame 24. The injection valve frame 24, in turn, includes a frame bottom 25 which is secured, in its assembled form to the mounting plate 2, by means of the valve mounting bolt 26 as shown in FIG. 2.

Figure 5:
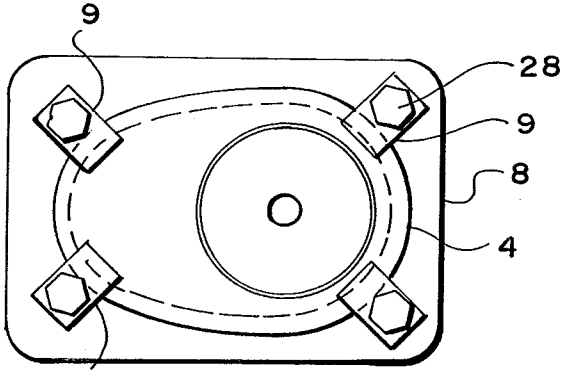
FIG. 5 is a plan view of the stationary plate showing how the same is clamped, and also illustrating section line 4—4 of FIG. 4 as to its location.
Figure 4:
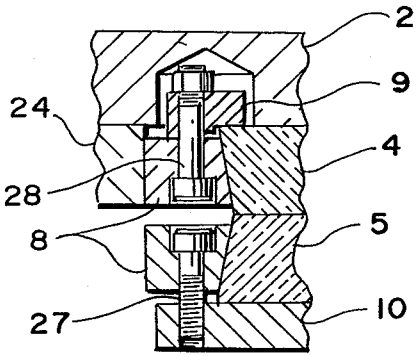
FIG. 4 is a partially enlarged broken sectional view illustrating the means for clamping the respective stationary plate and sliding injection plate.

Turning now to FIG. 4 which is a section taken through FIG. 5, it will be seen that clamp ring mounting screw 27 engages the sliding plate carrier 10 and secures the sliding injection plate 5 by means of its associated refractory clamp ring 8 into position. This securement by screw 27 in essence couples the metal carrier frame 10 to the refractory injection sliding plate 5 and permits them to move in unison. Similarly, clamp block mounting bolt 28 is secured to the metal clamp block 9, and therefore retains the refractory stationary plate 4 in position.

Figure 12:
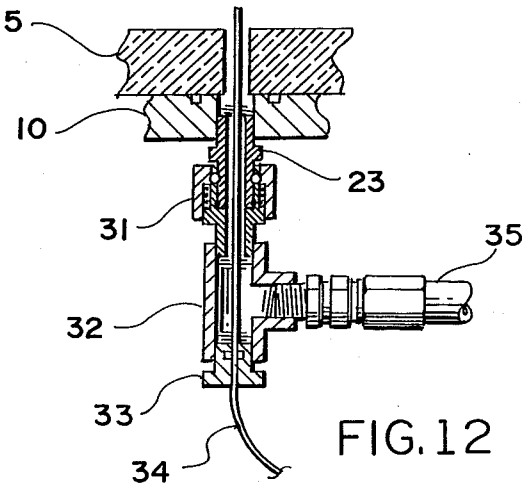
FIG. 12 is a section through the multi-media injectant coupling in enlarged scale, and illustrating the introduction of wire along with gases or gas entrained solids, or liquids.

Carrier puller pivot pin 29 is in turn positioned and held in place by means of the retainers set screw 30. The key element secured to the carrier 10 is the female half of the quick connect coupler 31 as shown in FIGS. 2 and 3. As shown in more detail, however, the male quick connect coupler 23 is secured to a female quick connect coupler 31 and terminates in a T-fitting 32 which, in turn, has one end plugged by means of a wire guide seal 33 which leads wire 34 into the vessel 1. The injection hose 35 as shown in FIG. 12 leads to the manifold 36 of FIG. 1, controlled by control valves 37 to the injectant supply 38.

Figure 9:
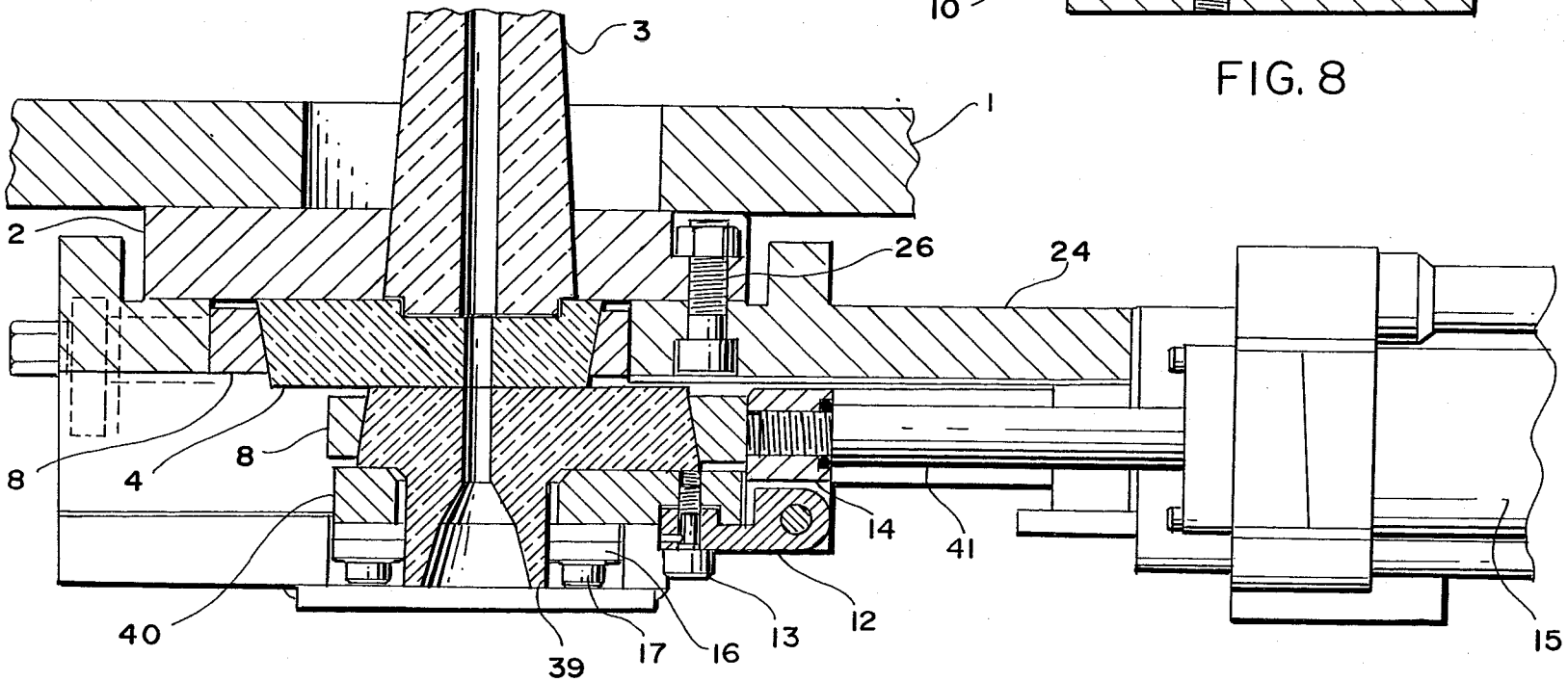
FIG. 9 is a view comparable to FIG. 2, but disclosing a lancing guide plate, and specifics of the power change mechanism.
Figure 10:
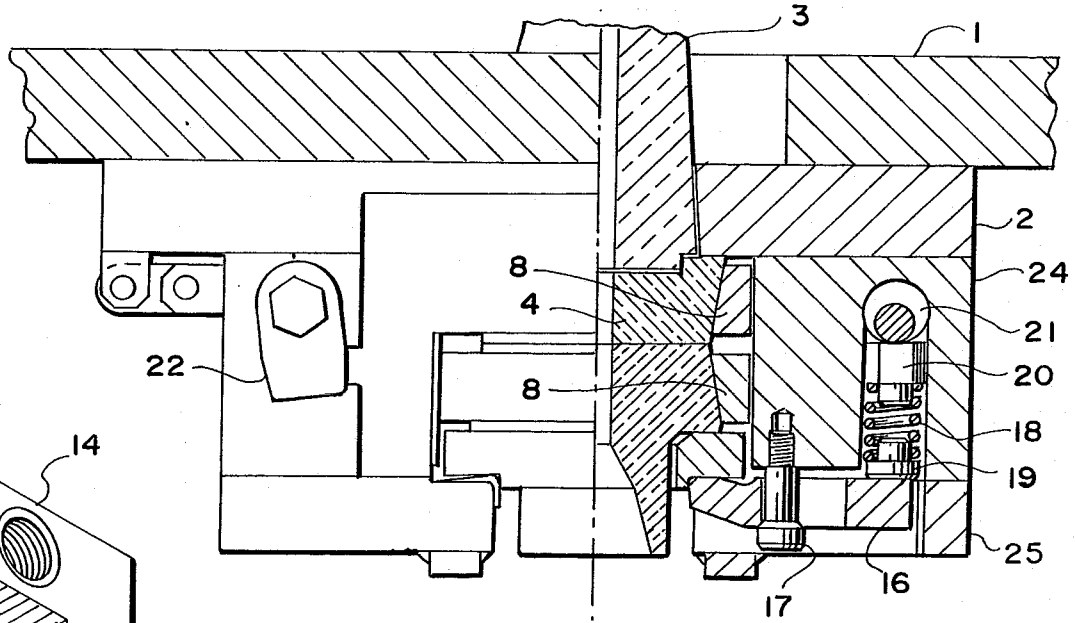
FIG. 10 is a transverse sectional view taken in the same scale as FIG. 9.

In FIGS. 9 and 10, the valve V is modified slightly to include the insertion of a lancing guide plate 39 secured in place by a lancing guide carrier 40 which is limited in its stroke by stroke limiter 41. Its usage is described below as the method of operation is set forth.

Figure 6:
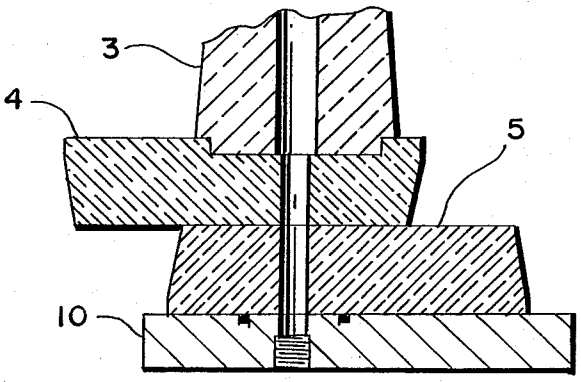
FIGS. 6, 7 and 8 show respectively the refractory members of the injection valve in which the slide plate of FIG. 6 has an injection orifice, the slide plate of FIG. 7 has a permeable plug for gases, and the sliding injection plate of FIG. 8 has a perforated insert for passing liquids, solids, or gases.
Figure 11:
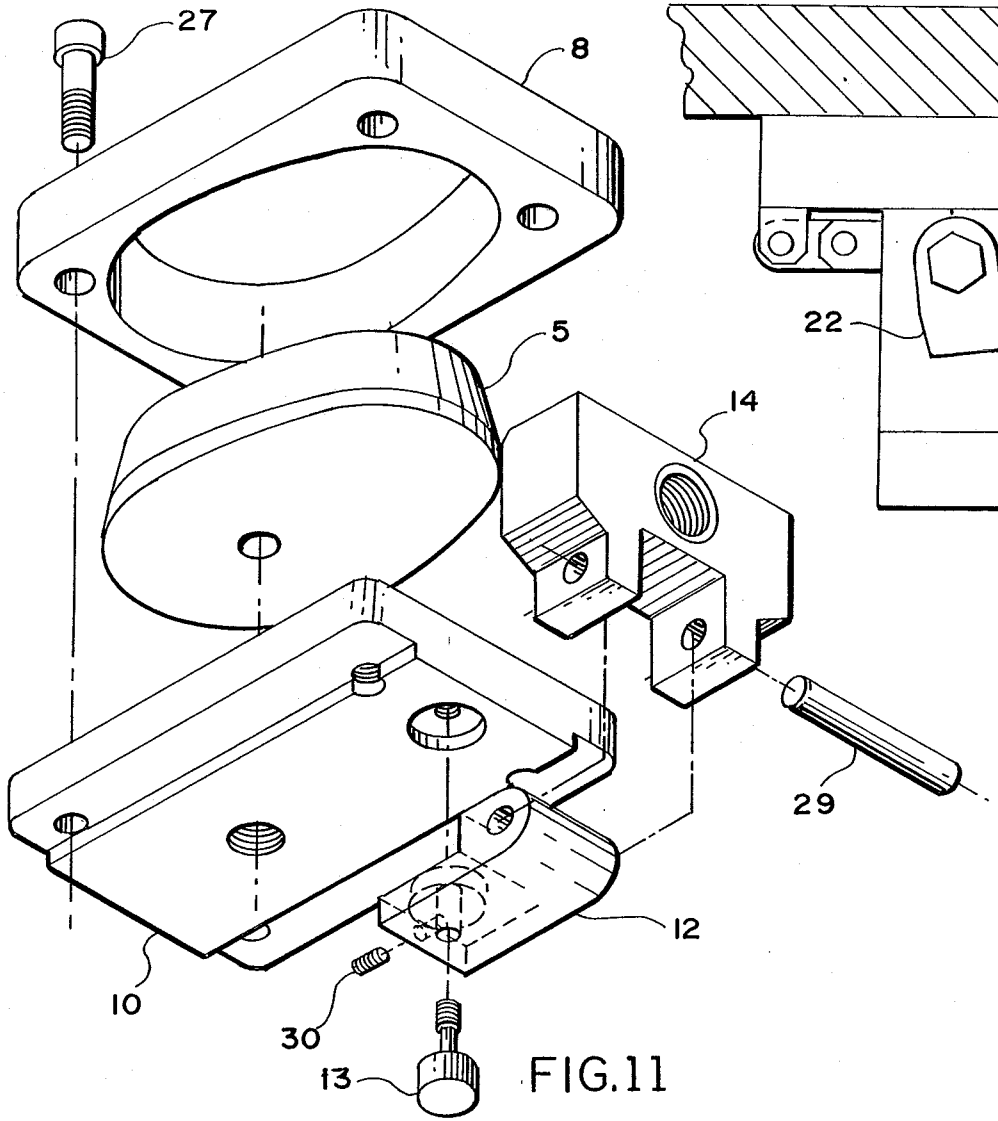
FIG. 11 is a partially exploded perspective view showing in spaced relationship the stationary plate, carrier plate, and portions of the drive mechanism.

As noted particularly in FIGS. 5 and 11, the refractory plates making up the stationary plate 4 and the sliding injection plate 5 are egg-shaped in plan view. The two plates may be substantially identical or, as shown in FIG. 6, the stationary plate 4 has a recess to nestingly receive the lower indented portion of the well block nozzle 3. The four clamps shown in FIG. 5 include primarily the clamp block 9 as well as the refractory clamp ring 8. The refractory clamp rings 8 in essence act as a peripheral retainer for both the stationary plate 4 and the sliding gate 5. The sliding gate 5, and its associated ring 8, are coupled for driving engagement with the hydraulic cylinder 15 as shown primarily in FIG. 2. The stationary plate 4 may be equipped with a circular recess insert 4'. This permits a nesting fit with the well nozzle 3.

Figure 7:
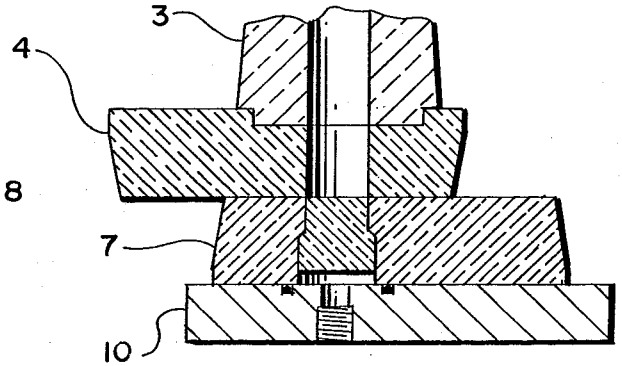
Figure 8:
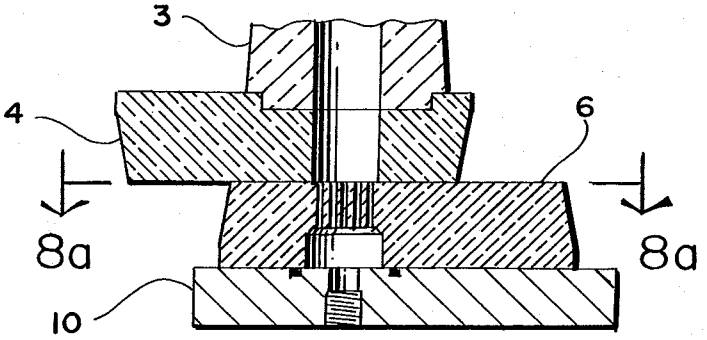
Figure 8A:
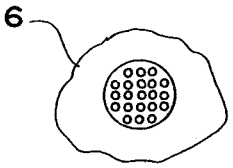
FIG. 8*a* is an enlarged view of the perforated plate insert in the slide gate shown in FIG. 8.

In each instance, as to the stationary plate 4 and injection slide gate 5, by providing the egg-shaped cross-section, there is refractory overlap when the slide gate 5 is in the closed position, or when the lancing guide 39 is secured in position by the lancing guide carrier 40 as shown in FIG. 9. The offset relationship between the slide plate 5 is shown in perspective in FIG. 11, and in exploded form. The stationary plate 4 is reversed from the axial location of the slide plate 5, but both are retained in a refractory clamp ring 8 to compressively engage the same and insure against expansive cracking during the thermo shock normally associated with a teeming operation. In FIG. 8*a*, as well as FIGS. 6 and 7, the variable types of slide plates 5 are shown. The configuration shown in FIG. 7 utilizes a permeable plug 7' for gases, and the configuration as shown in FIG. 8 utilizes a perforated plate in the central orifice as shown in both FIGS. 8 and 8*a*.

METHOD

When there is to be an injection valve plate change, the first step is to extend the cylinder 15 to its maximum position of extension. Then puller attachment screw 13 is backed out. Then the carrier puller 12 is disengaged from the sliding plate carrier 10. Subsequently the stroke limiter 41 is removed, and the cylinder 15 is fully retracted.

At this point the operator inserts a replacement carrier 10 with sliding injection plates 5, 6 and 7 (as shown in the FIGS. 6, 7 and 8) or lancing guide carrier 40 with lancing guide plate 39. Once these elements are preassembled with the refractory clamp rings 8 and the clamp ring mounting screws 27, the same is in the "ready position" in front of cylinder 15. At this point the operator engages the carrier puller 12 in replacement sliding plate carrier 10 or replacement lancing guide carrier 40, and the same is secured with the puller attachment screw 13.

Thereafter the cylinder 15 is actuated to its fully extended position to push out the old sliding plate carrier assembly and insert the new one. At this point the stroke limiter 41 is replaced. Upon repeats, the above steps are undertaken. In most operations, the well block nozzle 3 orifice, as well as the orifice of the stationary plate 4 will be packed with an inert material, and the slide gate 5 shut off. Thus the valve is ready to inject after the vessel 1 has been charged with molten metal. When that is ready, the gas is pressurized through the quick connect coupler 23 and hose 35, and then the sliding injection plate 5 is powered into the injection position and continually fed with gas until the teeming operation is concluded.

An alternative operating procedure which is not power driven involves similarly filling the bore of the well block nozzle 3 and the stationary plate 4 with a bore fill material and in the same manner as using the vessel when it is prepared for use with a sliding gate valve of the type shown in U.S. Pat. No. 4,063,668.

The vessel is then filled with molten metal and may be held for an indefinite period of time awaiting the initiation of injection and ladle metalurgy. The injection process is initiated by pressurizing argon gas into the injection valve V. The argon gas then displaces the bore fill material which floats to the top of the melt. Injection then continues in any manner deemed necessary to achieve the desired metalurgical results including gas bubbling, solids injection, liquids injection, and any combination of the foregoing. This occurs in various combinations and sequences, all as controlled by the control valves 37.

At the termination of injection the valve is cycled closed by moving the sliding injection plate 5 and then the gas flow is turned off. At any time when the valve is in open communication with the metal in the vessel 1, there must be gas flow to prevent the intrusion of molten metal into the valve well nozzle 3 and stationary plates 4.

When the heat or cast is finished and the station for service of the injection valve has been reached, the injection valve is serviced by replacing the injection plate 5 with a lancing guide 39. The lancing guide 39 is installed and put under spring pressure to seal the lancing guide 39 to the stationary plate 4 and damage is minimized or eliminated during the lancing operation. An oxygen lance is then inserted into the opening in the lance guide 39 and then burns out the opening plugged with metal in the stationary plate 4 in the well block nozzle 3. When the lancing is completed, spring pressure is released and the lancing guide 39 is removed from the valve V. At this time the bore of the stationary plate 4 and the well block nozzle 3 are visually inspected. If they have eroded too large a bore, the stationary plate and well nozzle 3, 4 are replaced. If the refractories are satisfactory the previous or a new injection plate 10 is loaded into the valve V, the spring pressure is reapplied by the cam 21, and the new plate and carrier are attached to the ram head. At this point the vessel is ready for pre-heat to accept another charge of metal.

In review it will be seen that an injection valve V has been described both as to structure and operation. The injection valve can have alternative types of sliding injection plates 5 as shown in FIGS. 6, 7 and 8, where the slide injection plate of FIG. 6 is perforate, the sliding injection plate of FIG. 7 (7) has a porous permeable plug for gases, and the sliding injection plate 6 as shown in FIG. 8 has a perforated plate for liquids or gases.

Although particular embodiments of the invention have been shown and described in full here, there is no intention to thereby limit the invention to the details of such embodiments. On the contrary, the intention is to cover all modifications, alternatives, embodiments, usages and equivalents as fall within the spirit and scope of the present invention, specification and appended claims.

What is claimed is:

1. A method of servicing an injection valve for a vessel having a well block nozzle which is in teeming communication with the vessel and the injection valve, said injection valve having a stationary refractory plate, a sliding refractory injection plate having an orifice therein, a carrier plate to which the sliding injection plate is secured, said carrier plate having loading sites, and a plurality of yieldable means engaging said loading sites, all of which are serviced and actuated by means of a power means engaging the sliding injection plate which moves in combination with the carrier plate comprising the steps of, at the termination of injection, converting the valve condition to shut-off, thereafter removing the carrier plate and its associated sliding plate refractory, and replacing the same with a lance guide plate having a tapered opening therebeneath, moving the lance guide plate into coaxial relationship with the sealed orifice portion of the stationary plate and the well block nozzle, utilizing an oxygen lance to open the orifice in the stationary refractory plate and the well block nozzle, replacing the lancing guide plate with a sliding injection plate and carrier assembly, thereafter moving the sliding injection plate and carrier into the shut-off position, thereafter inserting the bore fill into an orifice in the stationary plate and well block nozzle prior to charging the vessel with a molten metal, and loading said yieldable means to in turn yieldably load said loading sites to compressively engage the injection plate with the stationary plate.

2. In the method of claim 1 above, engaging means provided within the valve to cause a power transport of the carrier plate and sliding plate to the off position.

3. In the method of claim 1, loading the spring loading of the respective plates by means of a cam, disengaging said cam to in turn disengage the pressure on the yieldable means which are forcing the refractories into compressive relationship, thereafter removing the carrier for manual replacement, and thereafter re-engaging the cam activating the yieldable means to secure all members in place.

4. In the method of claim 1 above, providing a manifold permitting multiple media injection into the injection valve.

5. In the method of claim 1 above, providing means for rapidly inserting a wire for alloying through the carrier and sliding injection plate.

6. In the method of claim 1, using a lancing guide assembly for use with the valve, providing said lancing guide to include a lancing guide carrier proportioned to be engaged by the yieldable means which are spring loaded, forming said lancing guide with a tapered central opening for guidingly receiving an oxygen lance in communication with the stationary plate and well block nozzle.

7. An injection valve for use at a molten metal interior portion of a teeming vessel comprising, in combination, a mounting plate securing the valve to the vessel at a molten metal interior portion thereof and at an orifice thereof, a well block nozzle positioned in the orifice for the injection valve having a central injection orifice, a stationary refractory plate at the upper portion of the injection valve positioned for injection communication through the stationary plate orifice in alignment with the well block orifice, a sliding refractory injection plate and sliding plate carrier each secured to the other, and positioned beneath the stationary plate and having a central orifice proportioned for communication with the orifices of the stationary plate and the well block nozzle, spring loaded rocker arm means secured to the valve and in compressive relationship with the sliding plate and carrier, and gas injection means secured to the lower portion of the carrier in open communication with the slide plate orifice for the injection of additives to the metal in the vessel.

8. In the injection valve of claim 7 above, cam means for removably securing a compressive relationship on the spring loaded rocker arm means.

9. In the injection valve of claim 7 above, power means for moving the injection plate and carrier, means for removably securing the power means to the combination of sliding gate and carrier, thereby permitting the manual removal of the carrier plate and slide plate upon deactivation of the springs loading the rocker arms.

10. An injection valve stationary plate comprising a refractory plate having two parallel planar faces and a pouring orifice, said refractory plate having an enlarged section and tapered sidewalls extending upwardly between said planar parallel faces, one of said faces being proportioned for relative sliding relationship with a slide plate, the planar configuration of said stationary plate being essentially egg shaped with the pouring orifice adjacent the intersection of the major and minor diameters of the egg-shaped cross-section.

11. In the stationary plate of claim 10 above, a recess central and concentric with the pouring orifice for receiving an extension on a well block injection nozzle portion.

12. An injection slide plate proportioned for sliding engagement with a stationary plate comprising, in combination, a refractory plate, said refractory plate having upper and lower faces, said refractory plate faces being egg-shaped, said refractory plate having an orifice at the intersection of the major and minor axis of said egg-shaped faces, said slide plate having tapered walls, said walls tapering outwardly in a direction away from the face of the slide plate intended for face-to-face sliding relationship with the stationary plate.

13. An injection valve lance guide for use with a vessel having a well block nozzle and stationary plate in teeming relationship with the nozzle comprising, said stationary plate portion having tapered sidewalls, said sidewalls tapering downwardly and outwardly from one face of said plate intended for sliding relationship with a stationary plate, a depending injection guide portion depending from the plate, said plate having an egg-shaped planar section, an orifice at essentially the intersection of the major and minor axes of said egg-shaped planar section of the plate of the lance guide, and a tapered opening extending downwardly and outwardly interiorly of the depending guide portion for receiving a lance in open communication with the stationary plate and well block nozzle at a teeming vessel.

14. In the lance guide of claim 13 above, said tapered opening having two frustoconical portions, the frustoconical portion with the extreme taper being immediately in communication with the orifice of the lance guide.

* * * * *